US010053802B2

(12) United States Patent
Xia et al.

(10) Patent No.: US 10,053,802 B2
(45) Date of Patent: Aug. 21, 2018

(54) METHOD AND APPARATUS FOR PRODUCING ULTRA-SMOOTH KNITTED FABRIC USING HAIRY YARN

(71) Applicant: Wuhan Textile University, Wuhan, Hubei (CN)

(72) Inventors: Zhigang Xia, Hubei (CN); Weilin Xu, Hubei (CN); Xin Liu, Hubei (CN); Genyang Cao, Hubei (CN); Hongjun Yang, Hubei (CN); Wenxiang Ye, Hubei (CN)

(73) Assignee: Wuhan Textile University, Wuhan, Hubei (CN)

( * ) Notice: Subject to any disclaimer, the term of this patent is extended or adjusted under 35 U.S.C. 154(b) by 145 days.

(21) Appl. No.: 15/194,505

(22) Filed: Jun. 27, 2016

(65) Prior Publication Data

US 2016/0304310 A1 Oct. 20, 2016

(30) Foreign Application Priority Data

Oct. 26, 2015 (CN) ..... 2015 1 0700119

(51) Int. Cl.

| | |
|---|---|
| ***D02J 3/00*** | (2006.01) |
| ***D01H 13/10*** | (2006.01) |
| ***D02G 1/00*** | (2006.01) |
| ***D06B 1/02*** | (2006.01) |
| ***D04B 35/26*** | (2006.01) |
| ***D02G 1/04*** | (2006.01) |
| ***D04B 15/38*** | (2006.01) |

(52) U.S. Cl.

CPC ..... *D02J 3/00* (2013.01); *D01H 13/104* (2013.01); *D02G 1/00* (2013.01); *D02G 1/04* (2013.01); *D04B 15/38* (2013.01); *D04B 35/26* (2013.01); *D06B 1/02* (2013.01)

(58) Field of Classification Search

CPC ..... D04B 35/26; D04B 35/32; D02G 1/06; D02J 3/00; D02J 3/08

See application file for complete search history.

(56) References Cited

U.S. PATENT DOCUMENTS 3,678,676 A * 7/1972 Rothwell ..... D02G 1/0233 57/284

3,777,465 A * 12/1973 Buzano ..... D02G 1/0233 57/282

(Continued)

*Primary Examiner* — Shaun R Hurley

(57) ABSTRACT

Method and apparatus for producing ultra-smooth knitted fabric using hairy yarn belong to a technical field of textile. Yarn is false-twisted in a rotary holding form, for rotating the yarn stem on an ironing face. Meanwhile, a directional hairiness stretching device directionally ejects a steam flow towards the yarn, for reversely and orderly pre-wrapping hairiness on the rotating stem of the yarn, which avoids the yarn imperfection occurrence as the hairiness randomly or vertically wrapping onto the yarn stem. A vortex hair-wrapping device is used, so as to reversely wrap all the rest hairiness on the stem of the yarn, wherein a wrapping direction is opposite to a yarn moving direction for increasing difficulty of pulling out the wrapped hairiness during weft knitting, and increasing hair-wrapping tightness and fastness. The ultra-smooth yarn treatment apparatus is reasonably constructed and easily operated, which facilitates wide application.

3 Claims, 3 Drawing Sheets

(56) References Cited

U.S. PATENT DOCUMENTS

| | | | | | |
|---|---|---|---|---|---|
| 5,146,739 | A * | 9/1992 | Lorenz | D02G 1/0266 | 57/264 |
| 5,263,311 | A * | 11/1993 | Feil | D02J 1/00 | 57/333 |
| 6,199,361 | B1 * | 3/2001 | Yakushi | D02G 1/0273 | 57/105 |
| 6,279,307 | B1 * | 8/2001 | Nakaji | B65H 59/00 | 57/264 |
| 6,332,311 | B1 * | 12/2001 | Todo | B65H 54/705 | 242/128 |
| 6,374,588 | B1 * | 4/2002 | Nakaji | D02G 1/0273 | 57/284 |
| 7,104,040 | B2 * | 9/2006 | Bertoli | B65H 54/705 | 57/350 |
| 7,552,580 | B2 * | 6/2009 | Xu | D01H 1/02 | 57/282 |
| 2008/0155786 | A1 * | 7/2008 | Xu | D01H 1/02 | 19/0.27 |

* cited by examiner

METHOD AND APPARATUS FOR PRODUCING ULTRA-SMOOTH KNITTED FABRIC USING HAIRY YARN

CROSS REFERENCE OF RELATED APPLICATION

The present invention claims priority under 35 U.S.C. 119(a-d) to CN 201510700119.4, filed Oct. 26, 2015.

BACKGROUND OF THE PRESENT INVENTION

Field of Invention

The present invention relates to a technical field of textile, and more particularly to method and apparatus for producing ultra-smooth knitted fabric using hairy yarn.

Description of Related Arts

Weft knitting produces a knitted fabric using one or several yarns simultaneously and laterally along a fabric to form loops which interlock with each other longitudinally by needles, wherein weft knitting is divided into the single-sided and the double-sided. Weft knitted fabric forming process is divided into three stages: yarn feeding, wherein yarn is fed into a forming area of a weft knitting machine with a constant tension; knitting, wherein the yarn in the forming area is processed with different loop-forming methods to convert into the weft knitted fabrics; and up-taking, wherein the weft knitted fabrics are reeled from the loop-forming area to form a fabric package with a certain tension. The weft knitting machine commonly comprises circular arranged knitting needles, which is called a circular machine or known as a knitting machine using crochet hooks or latch needles as the key parts of loop-forming and cone yarn as the feeding material. The cone yarn is formed by winding bobbin yarns onto a cone package. Modern winding process is characterized by high speed and automation, wherein an automatic winding speed can be up to 1200 m/min, leading to serious problems of yarn during winding. In practice, it is noticed that after automatic winding, bobbin yarn total hair amount are increased by 3-6 times, wherein the hairs equal to or longer than 4 mm present higher increase amplitudes. Cone yarn with excessive long hairs will lower resultant fabric appearance due to entanglements of hairs to form yarn imperfections such as thick places, neps. Furthermore, long hairs of cone yarn are easily wrapped or wounded onto the knitting needles to break or even destruct them, reducing knitting efficiency dramatically.

For solving the above problems caused by yarn hairiness, current solutions are: improving weft knitting yarn hairiness property, and improving weft knitting processes as well as technologies; wherein improvement of weft knitting yarn hairiness property mainly solves the problem that yarn hairiness is over-increased during winding. Although it is possible to solve the problem by singeing of yarn, the singeing of yarn leads to fiber material losses and wastes. With rising costs of fiber materials, manufacturers are not likely to adapt singeing. Winding process optimization can partly suppress yarn hairiness increase by grinding and waxing, but employing hairiness reducing devices during winding are considered effective methods to solve yarn hairiness problems. There are a lot of relevant patents for the effective methods; however they are with similar principles, wherein in a winding machine, a forward-moving yarn is just roughly treated by one-step false-twisting method or one-step vortex rotating method; in such a manner that yarn hairs can be partly reduced by re-winding them onto yarn surface. Representatively, European patent EP 0,866,014 A2, published Sep. 23, 1998, Auto Winder, discloses mechanical action of false-twisting disc during winding, which forces free protruding fiber ends to return to a yarn body along a twisting direction, so as to reduce the yarn hairiness. U.S. Pat. No. 6,374,588 B1, published Apr. 23, 2002, Hairiness controlling device and winder, discloses mechanical action of false-twisting disc during winding, which forces free protruding fiber ends to return to a yarn body along a twisting direction, so as to reduce the yarn hairiness. European patent EP 1,146,002 A2, published Oct. 17, 2001, Automatic winder and hairiness suppressing device, discloses using an air vortex tube, so as to generate rotary airflow to re-wrap hairiness onto yarn body to reduce hairiness. In principle, airflow alone is not able to provide a sufficient wrapping effect. European patent EP 1,013,803 A2, published Jun. 28, 2000, *Hairiness suppressing device for automatic winder*, also discloses using an air vortex tube, which rotates yarn with airflow. When the rotating yarn passes through a regulating plate, fibers wrap onto a yarn body, in order to reduce hairiness. Chinese patent ZL99127507.1, published Jul. 5, 2000, *Hairiness suppressing device for automatic winder*, also discloses using an air vortex tube, which rotates yarn with airflow. However, two controller are provided at both ends of the device for ensuring yarn rotates along an axis thereof and causes a false-twisting effect, improving efficiency of reducing yarn hairiness. In addition, Chinese patent ZL 200710052991.8, published Jan. 23, 2008, *Method to reduce yarn hairiness*, discloses false-twisting ironing method, which attaches yarn and wraps yarn hairiness during winding; however a very small amount of the hairiness is involved into a yarn body, so as to reduce the yarn hairiness during winding and knitting. Above methods and devices for reducing yarn hairiness have common functions: only suppressing the amount increase of yarn hairs by flattening or re-wrapping them onto yarn stem via airflow or mechanical force. Practical applications show that the flattened or re-wrapped hairiness has three defects: firstly, the hairiness flattening or re-wrapping direction is opposite to the moving direction of yarn as it is winded to form a cone package, then the flattened or re-wrapped hairiness is directional to the moving of yarn as it is un-winded from the cone package during weft-knitting process, in which the flattened or re-wrapped hairiness is extremely easy to be scraped or bounced out; secondly, throughout flattening or re-wrapping process, the yarn hairiness lacks of positive and effective nipping force to improve the surface structure compactness, leading to a loose flattened or wrapped structure which facilitates the hairiness reformation of yarn enduring friction or rubbing again; thirdly, yarn imperfections such as neps and thick places are largely increased due to the fiber concentrations when the hairiness roughly flattened or re-wrapped onto yarn stem. To solve the problem, Chinese Patent ZL 201410204503.0, published May 15, 2014, Method for improving yarn surface structure with positively holding, discloses wrapping yarn surface hairiness tightly on a yarn stem by a negative pressure holding. It is proved by practice that the method is able to effectively improve the hair-wrapping tightness. However, technical problems are still not solved such as the hairiness wrapping direction opposite to the yarn moving direction, yarn imperfection formation due to the rough wrapping hairiness concentrations. Moreover, above conventional hairiness reduction devices are not able to solve the hairiness problem at a room temperature for spun yarn of highly resilient fibers (such as wool fibers) and high stiffness fibers (such as hemp fibers).

Currently, there are two main methods for improving weft knitting techniques and technologies. Firstly, weft knitting processes simply employ the yarn hairiness reduction techniques and devices which are commonly used for winding process. However, many fatal technical problems still exist: the hairiness reduction techniques and devices only partly decrease yarn hairiness, instead of eliminating yarn hairiness thoroughly; the remaining hair ends in knitted fabric facilitates the decreased hairiness greatly protruding out of fabric surface again after repeated washing, scouring and bleaching. Disappointedly, after introducing and grafting the above techniques, such problems as hairiness wrapping direction, thorough hairiness elimination and yarn increased imperfections due to fiber concentration are still unsolved. Thus, ultra-smooth weft knitting using hairy cone yarn is impossible by simply employing the hairiness reducing techniques and devices for yarn winding processes. The second method is using weft knitting processes optimization to improve the weft-knitting quality such as reducing friction by waxing, eliminating static electricity by wetting, and setting yarn by steaming; Obviously, the second method only improves the weft knitting from aspects such as friction reduction, heat setting, and static electricity elimination, which is not directly aimed to solve those weft knitting problems caused by the yarn surface hairiness, and is not able to achieve the ultra-smooth weft knitting production of hairy yarn.

SUMMARY OF THE PRESENT INVENTION

For overcoming the above problems, an object of the present invention is to provide a method and apparatus for producing ultra-smooth knitted fabric using hairy yarn, which effectively processes the hairy yarn with ultra-smooth treatment during weft kitting, so as to achieve ultra-smooth weft knitted fabric. Accordingly, in order to accomplish the above object, the present invention provides:

a method and apparatus for producing ultra-smooth knitted fabric using hairy yarn, comprising steps of: inputting yarn, each of which is unwound from a cone yarn package on a yarn creel of each yarn knitting mechanism of a weft knitting machine, into a yarn guider of a knitting mechanism through a yarn feeder, then guiding the yarn into a knitting area of the knitting mechanism through the yarn guider; converting the yarn into a knitted fabric with a looping unit in the knitting area; and guiding the knitted fabric out of the knitting area with a rotary up-taking unit and winding the knitted fabric onto a cloth roller for weft knitting. According to the present invention, on each yarn knitting mechanism of the weft knitting machine, an ultra-smooth yarn treatment apparatus is placed between the yarn feeder and the yarn guider, which comprises a holder, a false-twisting device, a heating device, a directional hairiness stretching device, and a vortex hair-wrapping device, wherein the false-twisting device and the vortex hair-wrapping device are respectively placed at two ends on a top surface of the holder; the false-twisting device is mounded on the holder by a first supporter and a second supporter, and the vortex hair-wrapping device is mounted on the holder by a connector; a yarn inlet of the vortex hair-wrapping device is corresponding to a second yarn guiding wheel in a false-twisting hollow shaft of the false-twisting device; the yarn inlet and the false-twisting hollow shaft are on a same plane perpendicular to the holder top surface; the heating device is provided between the vortex hair-wrapping device and the false-twisting device, and an ironing face of the heating device is parallel to the false-twisting hollow shaft of the false-twisting device while the ironing face is 0-5 mm higher than a highest horizontal section of a wheel slot bottom of the second yarn guiding wheel; the ironing face is at a same level as a yarn passage at a center of a hot cone static spindle of the vortex hair-wrapping device; an elastic yarn presser is provided on the ironing face of the heating device; the directional hairiness stretching device is provided at a side of the heating device and is in a tube form; the directional hairiness stretching device is mounted on the top surface of the holder through a thermal isolation holder and is along a direction which forms a angle ranged from 120 to 160 degrees with the false-twisting hollow shaft; a gas outlet of the directional hairiness stretching device is rectangle and is at a same level as the ironing face of the heating device; a plane, where the gas outlet is, is parallel to and is 1-6 mm away from an axis of the false-twisting hollow shaft. A tensioned yarn Y is delivering forward from the yarn feeder with a speed of 1-6 m/min. Under the guidance by a yarn input hook, the tensioned yarn Y enters the yarn passage of the false-twisting hollow shaft which rapidly rotates in a false-twisting device; outputting from the yarn passage, the yarn Y reaches the ironing face of the heating device under a S-shape path guidance by a wheel slot of a first yarn guiding wheel and a wheel slot of the second yarn guiding wheel in the false-twisting hollow shaft; the yarn Y is tightly pressed against the ironing face by the elastic yarn presser thereon; the false-twisting hollow shaft, which rapidly rotates, drives the wheel slot of the first yarn guiding wheel and the wheel slot of the second yarn guiding wheel to false-twist the tensioned yarn Y in a rotary holding form, so as to rotate the stem S of the tensioned yarn Y moving on the ironing face; meanwhile, the gas outlet of the directional hairiness stretching device directionally ejects a steam flow towards the tensioned yarn Y along a direction which forms a angle ranged from 20 to 60 degrees with the tensioned yarn Y forward direction, then hairiness H of the tensioned yarn Y is directionally stretched by the steam flow in a direction which forms a angle ranged from 120 to 160 degrees with the tensioned yarn Y forward direction; the hairiness H after being directionally stretched is thoroughly softened on the ironing face, in such a manner that the softened hairiness H of the tensioned yarn Y, pre-wraps reversely to yarn forward direction and orderly on the rotating stem S of the tensioned yarn Y. Meanwhile, the tensioned yarn Y with pre-wrapped hairiness is heat-set on the ironing face; after outputting from the ironing face, the yarn with heat-set pre-wrapped hairiness enters a vortex chamber of the vortex hair-wrapping device through the yarn inlet, and the rest un-wrapped hairiness H on the tensioned yarn Y surface is tightly pressed against a surface of the hot cone static spindle by a vortex airflow in the vortex chamber; the rest un-wrapped hairiness H is held by outer hot surface friction of the cone shaped static spindle and meanwhile blew to rotate by the vortex airflow as well as dragged forwards by an up-taken force, in such a manner that the rest un-wrapped hairiness H reversely wraps on the stem S of the tensioned yarn Y along a direction which forms a angle ranged from 120 to 160 degrees with the yarn forward direction, so as to effectively stabilize and fix the heat-set pre-wrapped hairiness H formed on the ironing face; then the tensioned yarn Y with all its hairiness H completely wrapped and fixed onto the stem S, obtains an ultra-smooth surface structure. Outputting through a yarn output wheel, the ultra-smooth yarn enters into the knitting area under the guidance of the yarn guider of the knitting mechanism; and the ultra-smooth yarn is converted into the knitted fabric with ultra-smooth appearance by the looping unit in the knitting area; the knitted fabric is dragged out of the knitting area by the up-taking unit and is wound onto the cloth roller for the weft knitting.

By adopting above technical solutions, compared with conventional technologies, a method and apparatus for producing ultra-smooth knitted fabric using hairy yarn of the present invention have advantages as follows. According to the present invention, the first yarn guiding wheel and the second yarn guiding wheel in the false-twisting hollow shaft of the false-twisting device are used for false-twisting the yarn in a rotary holding form, so as to rotate the yarn stem as it passing on the ironing face. Meanwhile, the gas outlet of the directional hairiness stretching device directionally ejects the steam flow towards the yarn along the direction which forms a angle ranged from 20 to 60 degrees with the moving direction of the yarn, then the hairiness of the yarn is directionally stretched by the steam flow in the direction which forms a angle ranged from 120 to 160 degrees with the moving direction of the yarn, so as to reversely and orderly pre-wrap on the rotating stem of the yarn, which avoids the yarn imperfection occurrence as the hairiness randomly or vertically wrapping onto the yarn stem. Therefore, the problem is effectively solved that yarn imperfections such as thick places and neps are greatly increased due to fiber concentration for the roughly re-wrapped hairiness. The steam flow ejected from a steam pipe outlet thoroughly softens the hairiness of the yarn passing on the ironing face, wherein highly resilient fibers (such as wool fibers) and high stiffness fibers (such as hemp and ramie fibers) are effectively softened, so as to eliminate stubborn surface hairiness of wool yarn, ramie yarn, etc., by effectively and tightly wrapping on the yarn body, which solves a problem that conventional hairiness reduction devices are not able to eliminate hairiness of the wool yarn and the ramie yarn at a room temperature. The vortex hair-wrapping device holds the rest hairiness of the yarn with hot surface friction for wrapping treatment, so as to reversely wrap all the hairiness onto the yarn stem, wherein the wrapping direction is opposite to the yarn moving direction for increasing difficulty of pulling out the re-wrapped hairiness during weft knitting; meanwhile effectively stabilizing and fixing the hairiness H of the tensioned yarn Y which reversely and orderly pre-wraps during a period on the ironing face, to achieve a complete yarn hairiness wrapping progressively. The whole hairiness wrapping process involves hydrothermal softening and heat setting, which effectively stabilizes and fixes the ultra-smooth yarn structure, and substantially increases tightness and fastness of hairiness wrapping, so as to solve a problem that the loose structure of yarn surface hair-wrapping for conventional hairiness reduction technologies leads to a large amount of hairiness reproduction due to friction. In addition, hydrothermal softened yarn is dragged by a tension, in such a manner that fibers of an inner structure is relatively stretched for improving fiber straightness, degree of orientation, and yarn strength. According to the present invention, a hydrothermal temperature and a rotation speed of the false-twisting hollow shaft are adjustable, which satisfies different yarn post-treatment requirements. According to the present invention, the ultra-smooth yarn treatment apparatus is reasonably constructed and easily operated, which is conducive to a wide application.

These and other objectives, features, and advantages of the present invention will become apparent from the following detailed description, the accompanying drawings, and the appended claims.

DETAILED DESCRIPTION OF THE PREFERRED EMBODIMENT

Figure 1:
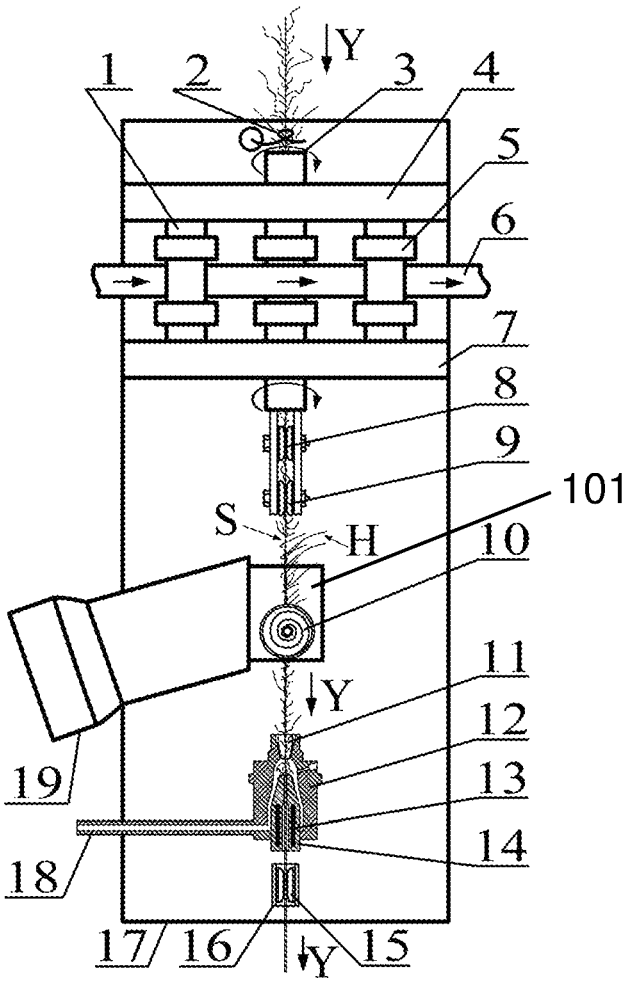
FIG. 1 is a sketch view of an ultra-smooth yarn treatment apparatus of the present invention during working.

Referring to the drawings, a method and apparatus for producing ultra-smooth knitted fabric using hairy yarn according to the present invention is further illustrated.

Figure 2:
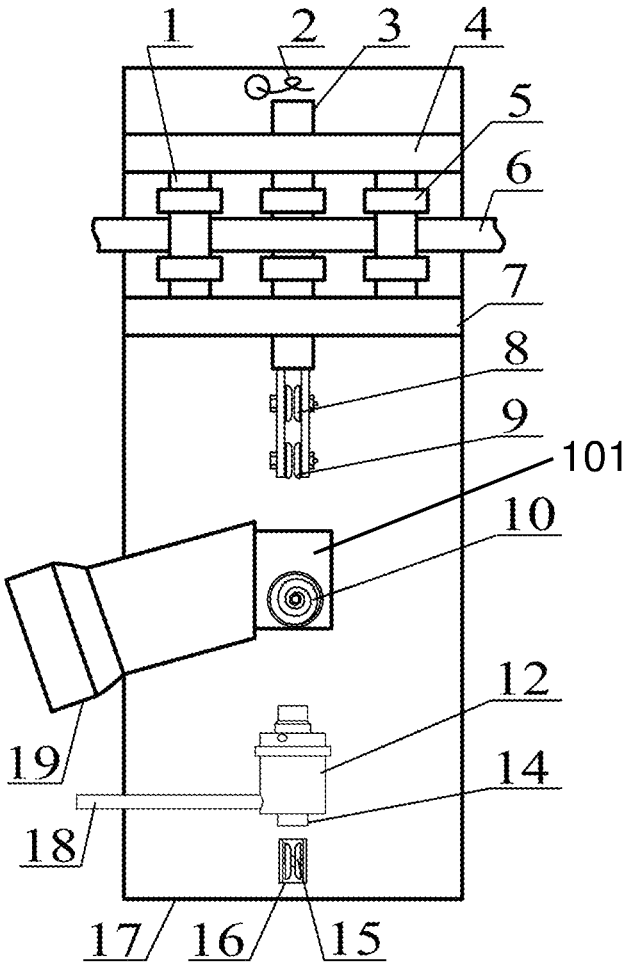
FIG. 2 is a sketch view of an ultra-smooth yarn treatment apparatus of the present invention.
Figure 3:
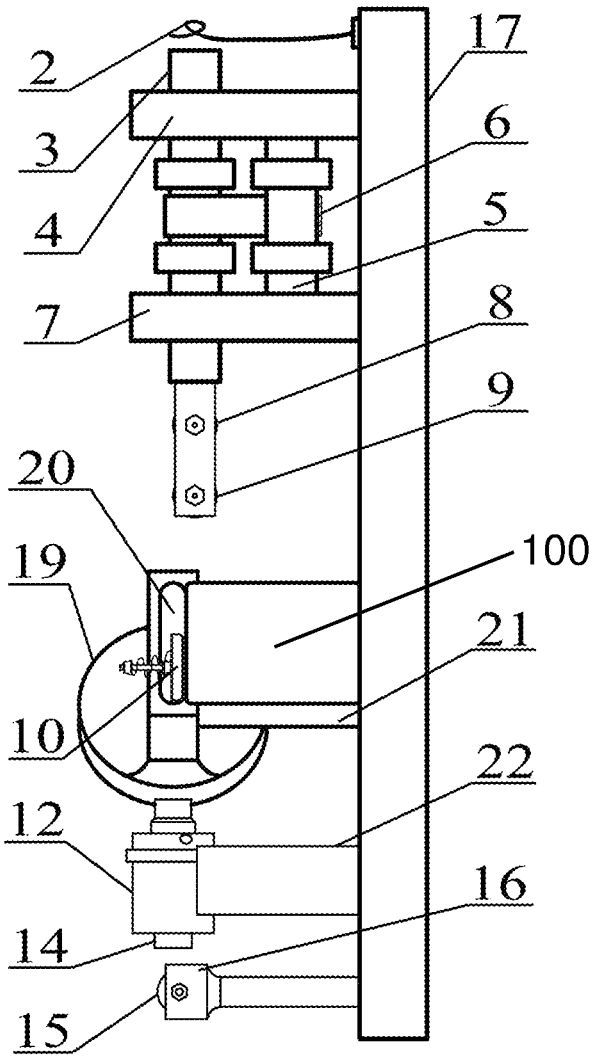
FIG. 3 is a side view of FIG. 2.

Referring to FIGS. 1-3, a method and apparatus for producing ultra-smooth knitted fabric using hairy yarn are provided, comprising steps of: inputting yarn, each of which is unwound from a cone yarn package placed on a yarn creel of each yarn knitting mechanism of a weft knitting machine, into a yarn guider of a knitting mechanism through a yarn feeder, then guiding the yarn into a knitting area of the knitting mechanism through the yarn guider; converting the yarn into a knitted fabric with a looping unit in the knitting area; and guiding the knitted fabric out of the knitting area with a rotary up-taking unit and winding onto a cloth roller for weft knitting. According to the present invention, on each yarn knitting mechanism of the weft knitting machine, an ultra-smooth yarn treatment apparatus is placed between the yarn feeder and the yarn guider, which comprises a holder 17, a false-twisting device, a heating device 100, a directional hairiness stretching device 19, and a vortex hair-wrapping device, wherein the false-twisting device and the vortex hair-wrapping device are respectively placed at two ends on a top surface of the holder 17. The false-twisting device comprises a first supporter 4, a second supporter 7, a false-twisting hollow shaft 3, a first belt guiding shaft 1, a second belt guiding shaft 5, a first yarn guiding wheel 8, and a second yarn guiding wheel 9, wherein the false-twisting device is mounded on the holder 17 by the first supporter 4 and the second supporter 7 which are parallel to each other. The false-twisting hollow shaft 3 comprises a shaft body and a yarn passage, wherein a belt slot is provided at a middle of the shaft body; the first belt guiding shaft 1 and the second belt guiding shaft 5 are symmetrically provided at a bottom left and a bottom right of the false-twisting hollow shaft 3 in parallel; belt slots are provided at middles of the first belt guiding shaft 1 and the second belt guiding shaft 5; a middle of the shaft body of the false-twisting hollow shaft 3, the first belt guiding shaft 1, and the second belt guiding shaft 5 are provided between the first supporter 4 and the second supporter 7; a first end and a second end of the shaft body of the false-twisting hollow shaft 3 respectively extend out of external sides of the second supporter 7 and the first supporter 4; the first yarn guiding wheel 8 and the second yarn guiding yarn 9, which are placed along an axis of the false-twisting hollow shaft 3, are provided at the first end which extends out of the external side of the second supporter 7; a wheel slot of the first yarn guiding wheel 8, a wheel slot of the second yarn guiding wheel 9 and the axis of the false-twisting hollow shaft 3 are at a same plane. The vortex hair-wrapping device is provided in front of the false-twisting hollow shaft 3, comprising a vortex tube 12, a hot cone static spindle 14 and a connector 22, wherein the vortex hair-wrapping device is mounted on the holder 17 by the connector 22; an end of the vortex tube 12 faces the second yarn guiding wheel 9 of the false-twisting hollow shaft 3, and an yarn inlet 11 is provided on the vertex tube 12; the hot cone static spindle 14 is fixedly inserted into another end of the vortex tube 12 and forms a vortex chamber with an inner wall of the vortex tube 12; an upper portion of the hot cone static spindle 14 is conical and is provided at a top portion inside the vortex chamber; a yarn tunnel is provided on the hot cone static spindle 14 along an axis thereof, and 3-4 air inlets are symmetrically provided along a radial direction of a tube wall of the vortex tube 12 corresponding to an inlet of the yarn tunnel; a lower portion of the hot cone static spindle 14 is cylindrical and is provided at a bottom portion of the vortex chamber; an air outlet 18 is provided on a tube wall of the vortex tube 12 corresponding to the bottom portion of the vortex chamber; a heating sheet 13 is provided inside a wall of the hot cone static spindle 14; the yarn inlet 11 of the vortex hair-wrapping device is corresponding to the second yarn guiding wheel 9 in the false-twisting hollow shaft 3 of the false-twisting device; the yarn inlet 11 and the false-twisting hollow shaft 3 are on a same plane perpendicular to the holder 17 top surface. The heating device 100 is provided between the vortex hair-wrapping device and the false-twisting device, wherein the heating device 100 is mounded on the top surface of the holder 17; the heating device 100 may be an ironing spinning device disclosed in Chinese patent application CN 201245734, published May 27, 2009, or other forms; an ironing face 101 of the heating device 100 is parallel to the false-twisting hollow shaft 3 of the false-twisting device while the ironing face is 0-5 mm higher than a highest horizontal section of a wheel slot bottom of the second yarn guiding wheel 9 in the false-twisting hollow shaft 3, wherein the higher the ironing face 101 is than the highest horizontal section of the wheel slot bottom of the second yarn guiding wheel 9, the larger a positive contacting pressure of the yarn on the ironing face 101 will be, and the tighter the hairiness will be when wrapping on the stem of the yarn; the ironing face 101 is at a same level as the yarn passage at a center of the hot cone static spindle 14 of the vortex hair-wrapping device. An elastic yarn presser 10 is provided on the ironing face 101 of the heating device 100. The directional hairiness stretching device 19 is provided at a side of the heating device 100 and is in a tube form, wherein the directional hairiness stretching device 19 is mounted on the top surface of the holder 17 through a thermal isolation holder 21 and is along a direction which forms a angle ranged from 120 to 160 degrees with the false-twisting hollow shaft 3; a gas outlet 20 of the directional hairiness stretching device 19 is rectangle and is at a same level as the ironing face 101 of the heating device 100; a plane, where the gas outlet 20 is, is parallel to and is 1-6 mm away from the axis of the false-twisting hollow shaft 3, wherein the closer the plane is from the axis of the false-twisting hollow shaft 3, the larger a directional ejecting force of the gas outlet 20 will be for stretching the hairiness of the yarn between the false-twisting hollow shaft 3 and ironing face 101. A yarn input hook 2 is provided at an input end of the ultra-smooth yarn treatment apparatus, wherein a center of the yarn input hook 2 and the axis of the false-twisting hollow shaft 2 are at a same line. A yarn output wheel 15 is provide at an output end of the ultra-smooth yarn treatment apparatus, wherein the yarn output wheel 15 is mounted on the top surface of the holder 17 by a supporting post 16; a highest horizontal section of a wheel slot bottom of the yarn output wheel 15 is at a same level as the yarn passage at the center of the hot cone static spindle 14. The false-twisting device is externally connected to a driving belt 6 through the false-twisting hollow shaft 3, the first belt guiding shaft 1, and the second belt guiding shaft 5, so as to drive the false-twisting hollow shaft 3 to rotate rapidly. The directional hairiness stretching device 19 is externally connected to a high-temperature high-pressure steam generator through a steam pipe, so as to eject a steam flow from the gas outlet 20, wherein a temperature of the steam flow is 100-150° C. The heating device 100 is externally connected to a power source through wires, for raising a temperature of the ironing face 101 to 100-170° C. The vortex hair-wrapping device is externally connected to a compressed air hose through the air inlet of the vortex tube 12, so as to guide a high-speed high-pressure airflow into the vortex chamber for forming vortex airflow which is outputted through the air outlet 18 of the vortex tube 12. The high-temperature high-pressure steam can be also guided into the vortex chamber for forming the vortex airflow, wherein a temperature of the vortex airflow is 100-150° C. The tensioned yarn Y is delivering forward from the yarn feeder with a speed of 1-6 m/min; under the guidance of a yarn input hook 2, the tensioned yarn Y enters the yarn passage of the false-twisting hollow shaft 3 which rapidly rotates in a false-twisting device; outputting from the yarn passage, the tensioned yarn Y reaches the ironing face 101 of the heating device 100 under a S-shape path guidance by the wheel slot of the first yarn guiding wheel 8 and the wheel slot of the second yarn guiding wheel 9 in the false-twisting hollow shaft 3; the tensioned yarn Y is tightly pressed against the ironing face 101 by the elastic yarn presser 10 thereon; the false-twisting hollow shaft 3, which rapidly rotates, drives the wheel slot of the first yarn guiding wheel 8 and the wheel slot of the second yarn guiding wheel 9 to false-twist the tensioned yarn Y in a rotary holding form, so as to rotate the tensioned yarn Y stem S moving on the ironing face 101; meanwhile, the gas outlet 20 of the directional hairiness stretching device 19 directionally ejects the steam flow towards the tensioned yarn Y along a direction which forms a angle ranged from 20 to 60 degrees with the tensioned yarn Y forward direction, then hairiness H of the tensioned yarn Y is directionally stretched by the steam flow in a direction which forms a angle ranged from 120 to 160 degrees with the tensioned yarn Y forward direction; the hairiness H after being directionally stretched is thoroughly softened on the ironing face for making the hairiness H of the tensioned yarn Y easier to bend and wrap, in such a manner that the softened hairiness H of the tensioned yarn Y, pre-wraps reversely to yarn forward direction and orderly on the rotary stem S of the tensioned yarn Y with a holding effect of the ironing face 101. As a result, the yarn imperfection occurrence is avoided as the hairiness randomly or vertically wrapping onto the yarn stem. Therefore, the problem is effectively solved that yarn imperfections such as thick places and neps are greatly increased due to fiber concentration for the hairiness wrapping. Then the tensioned yarn Y is processed with heat setting on the ironing face 101; after the heat setting, the tensioned yarn Y with heat-set pre-wrapped yarn hairiness is passed though the ironing face 101 and enters a vortex chamber of the vortex hair-wrapping device through the yarn inlet 11, and the rest un-wrapped hairiness H on a surface of the tensioned yarn Y is tightly pressed against a surface of the hot cone static spindle 14 by a vortex airflow in the vortex chamber; the rest un-wrapped hairiness H is held by hot surface friction of the hot cone static spindle 14 and meanwhile blew to rotate by the vortex airflow as well as dragged forwards by an up-taken force, in such a manner that the rest un-wrapped hairiness H of the tensioned yarn Y reversely wraps on the stem S of the tensioned yarn Y along a direction which forms a angle ranged from 120 to 160 degrees with the moving direction of the tensioned yarn Y. The wrapping direction is opposite to the yarn moving direction, increasing difficulty of pulling out the wrapped hairiness during weft knitting; meanwhile the wrapped hairiness by the vortex hair-wrapping device effectively stabilizing and fixing the pre-wrapped hairiness H on the ironing face 101. Thus, all hairiness H of the tensed yarn Y completely wrapped and fixed onto the stem S, which forms an ultra-smooth surface structure of yarn. The whole hairiness wrapping process involves hydrothermal softening and heat setting, which effectively stabilizes and fixes the surface structure of ultra-smooth yarn, and substantially increases tightness and fastness of hairiness wrapping, so as to solve the problem of loose hair-wrapping structure in conventional hairiness reducing technologies, and the problem of a large amount of yarn hairs reproducing due to friction. The tensioned yarn Y, whose hairiness H is processed with complete wrapping and fixing, obtains an ultra-smooth surface structure. In addition, hydrothermal softened yarn is dragged by a tension, in such a manner that fibers of an inner structure is relatively stretched for improving fiber straightness, degree of orientation, and yarn strength. Outputting through the yarn output wheel 15, the yarn Y with stable ultra-smooth structure and improved strength enters the yarn guider of the knitting mechanism. Under the guidance of the yarn guider, the tensioned yarn Y with stable ultra-smooth surface structure is fed into the knitting area of the knitting mechanism; and the yarn is converted into the knitted fabric with the looping unit in the knitting area; the knitted fabric is dragged out of the knitting area with the rotary up-taking unit and is wound onto the cloth roller for the weft knitting.

It is proved in practice that compared with conventional weft knitting, the weft knitted fabric according to the present invention, which is produced with ring spun 50 English counts cotton knitting yarn, has an ultra-smooth surface (wherein a yarn feeding speed of the yarn feeder is 1.2 m/min). Furthermore, wear-resistance of the fabric is improved by 2 grades.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for producing smooth knitted fabric using hairy yarn, comprising steps of:

inputting yarn, each of which is unwound from a cone yarn package on a yarn creel of each yarn knitting mechanism of a weft knitting machine, then guiding the yarn into a knitting area of the knitting mechanism; converting the yarn into a knitted fabric with a looping unit in the knitting area; and guiding the knitted fabric out of the knitting area with a rotary up-taking unit and winding the knitting fabric onto a cloth roller for weft knitting;

wherein the tensioned yarn (Y) is delivering forward from the yarn feeder with a speed of 1-6 m/min; under the guidance of a yarn input hook (2), the tensioned yarn (Y) enters a yarn passage of a false-twisting hollow shaft (3) which rapidly rotates in a false-twisting device; outputting from the yarn passage, the tensioned yarn (Y) reaches an ironing face (101) of a heating device (100) under a S-shape path guidance by a wheel slot of a first yarn guiding wheel (8) and a wheel slot of a second yarn guiding wheel (9) in the false-twisting hollow shaft (3); the tensioned yarn (Y) is pressed against the ironing face (101) by an elastic yarn presser (10) thereon; the false-twisting hollow shaft (3), which rapidly rotates, drives the wheel slot of the first yarn guiding wheel (8) and the wheel slot of the second yarn guiding wheel (9) to false-twist the tensioned yarn (Y) in a rotary holding form, so as to rotate the stem (S) of the tensioned yarn (Y) moving on the ironing face (101);

meanwhile, a gas outlet (20) of a directional hairiness stretching device (19) directionally ejects a steam flow towards the tensioned yarn (Y) along a direction which forms an angle of 20 to 60 degrees with the tensioned yarn (Y) forward direction, then hairiness (H) of the tensioned yarn (Y) is directionally stretched by the steam flow in a direction which forms an angle of 120 to 160 degrees with the tensioned yarn (Y) forward direction; the hairiness (H) after being directionally stretched is thoroughly softened on the ironing face (101), in such a manner that the softened hairiness (H) of the tensioned yarn (Y), pre-wraps reversely to yarn forward direction and orderly on the rotating stem (S) of the tensioned yarn (Y); meanwhile, the tensioned yarn (Y) with per-wrapped hairiness is heat-set on the ironing face (101); after outputting from the ironing face (101), the yarn with heat-set pre-wrapped hairiness enters a vortex chamber of a vortex hair-wrapping device through a yarn inlet (11), and the un-wrapped hairiness (H) on the tensioned yarn (Y) surface is pressed against a surface of a hot cone static spindle (14) by a vortex airflow in the vortex chamber; the un-wrapped hairiness (H) is held by outer hot surface friction of the hot cone static spindle (14) and meanwhile blew to rotate by the vortex airflow as well as dragged forwards by an up-taken force, in such a manner that the un-wrapped hairiness (H) reversely wraps on the stem (S) of the tensioned yarn (Y) along a direction which forms an angle of 120 to 160 degrees with the tensioned yarn (Y) forward direction, so as to effectively stabilize and fix the heat-set pre-wrapped hairiness (H) formed on the ironing face (101); then the tensioned yarn (Y) with its all hairiness (H) completely wrapped and fixed onto the stem (S), obtains an smooth surface structure; outputting through a yarn output wheel (15), the smooth yarn enters into the knitting area and is converted into the knitted fabric with smooth appearance by the looping unit in the knitting area.

2. The method for producing the smooth knitted fabric using the hairy yarn, as recited in claim 1, wherein the smooth yarn treatment apparatus comprises a holder (17), the false-twisting device, the heating device (100), the directional hairiness stretching device (19), and the vortex hair-wrapping device, wherein the false-twisting device and the vortex hair-wrapping device are respectively provided at two ends on a top surface of the holder (17); the false-twisting device is mounded on the holder (17) by a first supporter (4) and a second supporter (7), and the vortex hair-wrapping device is mounted on the holder (17) by a connector (22); the yarn inlet (11) of the vortex hair-wrapping device is corresponding to the second yarn guiding wheel (9) in the false-twisting hollow shaft (3) of the false-twisting device; the yarn inlet (11) and the false-twisting hollow shaft (3) are on a same plane perpendicular to the holder (17) top surface; the heating device (100) is provided between the vortex hair-wrapping device and the false-twisting device, and the ironing face (101) of the heating device (100) is parallel to the false-twisting hollow shaft 3 of the false-twisting device while the ironing face (101) is 0-5 mm higher than a highest horizontal section of a wheel slot bottom of the second yarn guiding wheel (9); the ironing face (101) is at a same level as the yarn passage at a center of the hot cone static spindle (14) of the vortex hair-wrapping device; the elastic yarn presser (10) is provided on the ironing face (101) of the heating device (100); the directional hairiness stretching device (19) is provided at a side of the heating device (100) and is in a tube form; the directional hairiness stretching device (19) is mounted on the top surface of the holder (17) through a thermal isolation holder (21) and is along a direction which forms an angle of 120 to 160 degrees with the false-twisting hollow shaft (3); the gas outlet (20) of the directional hairiness stretching device (19) is rectangular and is at a same level as the ironing face (101) of the heating device (100); a plane, where the gas outlet (20) is, is parallel to and is 1-6 mm away from an axis of the false-twisting hollow shaft (3).

3. An apparatus for producing smooth knitted fabric using hairy yarn, comprising a holder (17), a false-twisting device, a heating device (100), a directional hairiness stretching device (19), and a vortex hair-wrapping device, wherein the false-twisting device and the vortex hair-wrapping device are respectively provided at two ends on a top surface of the holder (17); the false-twisting device is mounded on the holder (17) by a first supporter (4) and a second supporter (7), and the vortex hair-wrapping device is mounted on the holder (17) by a connector (22); a yarn inlet (11) of the vortex hair-wrapping device is corresponding to a second yarn guiding wheel (9) in a false-twisting hollow shaft (3) of the false-twisting device; the yarn inlet (11) and the false-twisting hollow shaft (3) are on a same plane perpendicular to the holder (17) top surface; the heating device (100) is provided between the vortex hair-wrapping device and the false-twisting device, and an ironing face (101) of the heating device (100) is parallel to the false-twisting hollow shaft (3) of the false-twisting device while the ironing face (101) is 0-5 mm higher than a highest horizontal section of a wheel slot bottom of the second yarn guiding wheel (9); the ironing face (101) is at a same level as a yarn passage at a center of a hot cone static spindle (14) of the vortex hair-wrapping device; an elastic yarn presser (10) is provided on the ironing face (101) of the heating device (100); the directional hairiness stretching device (19) is provided at a side of the heating device (100) and is in a tube form; the directional hairiness stretching device (19) is mounted on the top surface of the holder (17) through a thermal isolation holder (21) and is along a direction which forms an angle of 120-160 degrees with the false-twisting hollow shaft (3); a gas outlet (20) of the directional hairiness stretching device (19) is rectangular and is at a same level as the ironing face (101) of the heating device (100); a plane, where the gas outlet (20) is, is parallel to and is 1-6 mm away from an axis of the false-twisting hollow shaft (3).

* * * * *